US006978925B2

(12) United States Patent
Morson

(10) Patent No.: US 6,978,925 B2
(45) Date of Patent: Dec. 27, 2005

(54) IN-LINE AUTOMATED PERFORATION METHOD USING SELECTIVE MULTI-HOLE PUNCH

(75) Inventor: Dino M. Morson, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/861,733

(22) Filed: Jun. 4, 2004

(65) Prior Publication Data

US 2004/0221698 A1 Nov. 11, 2004

Related U.S. Application Data

(62) Division of application No. 10/029,313, filed on Dec. 28, 2001, now Pat. No. 6,869,010.

(51) Int. Cl.[7] ..... B26F 1/14; G03G 15/00; B26D 5/02

(52) U.S. Cl. ..... 234/1; 234/50; 83/76.8; 83/76.9; 83/345; 83/670; 83/370; 83/368; 83/694; 83/691; 83/987; 270/58.07; 399/407

(58) Field of Search ..... 83/13, 334, 345, 83/669, 670, 687, 622, 609, 685, 694, 549, 83/559, 691, 335, 690, 304, 305, 684, 688, 83/663, 76.9, 76.8, 370, 368; 234/50, 55, 234/38, 39, 1; 270/58.07; 399/407

(56) References Cited

U.S. PATENT DOCUMENTS

| | | | | |
|---|---|---|---|---|
| 2,327,646 | A * | 8/1943 | Hutchinson | 83/550 |
| 3,705,683 | A | 12/1972 | Tsukihashi | 234/87 |
| 5,253,030 | A * | 10/1993 | Shigemura et al. | 399/407 |
| 5,685,532 | A | 11/1997 | Amarakoon | 270/58.07 |
| 5,887,502 | A * | 3/1999 | Yamaguchi et al. | 83/76 |
| 6,065,383 | A | 5/2000 | Takaishi et al. | 83/368 |
| 6,295,908 | B1 * | 10/2001 | Holzhauser et al. | 83/76.9 |
| 6,305,262 | B1 * | 10/2001 | Watanabe | 83/670 |
| 6,374,715 | B1 * | 4/2002 | Takatsuka | 83/620 |
| 6,381,443 | B1 * | 4/2002 | Kawata et al. | 399/407 |
| 6,549,734 | B2 * | 4/2003 | Yamada et al. | 399/81 |
| 6,672,504 | B1 * | 1/2004 | Ueda et al. | 234/50 |
| 6,869,010 | B2 * | 3/2005 | Morson | 234/50 |
| 2002/0000149 | A1 * | 1/2002 | Miura et al. | 83/628 |
| 2003/0116004 | A1 * | 6/2003 | Tanaka et al. | 83/669 |
| 2004/0045421 | A1 * | 3/2004 | Ueda et al. | 83/364 |

FOREIGN PATENT DOCUMENTS

| | | |
|---|---|---|
| JP | 11-44543 | * 9/2000 |
| JP | 11-205677 | * 2/2001 |
| JP | 2000-169890 | * 12/2001 |

* cited by examiner

*Primary Examiner*—Boyer D. Ashley

(57) ABSTRACT

A method for creating multiple punch holes during a finishing process of paper sheets and other sheet materials. A highlight of the present invention is the ability to select between at least two configurations of punch holes automatically, without manual adjustment, and "on-the-fly" without interruption of the sheet or paper flow. The perforation method utilizes two rotatable punches set at different angles such that when one intersects the sheet path, the other clears the sheet path. The speed of rotation is controlled such that the non-selected punch intersects the sheet path in a space between pitches.

24 Claims, 5 Drawing Sheets

IN-LINE AUTOMATED PERFORATION METHOD USING SELECTIVE MULTI-HOLE PUNCH

CROSS-REFERENCE TO RELATED APPLICATIONS

This is a divisional of U.S. application Ser. No. 10/029,313 filed Dec. 28, 2001 (now U.S. Pat. No. 6,869,010 issued Mar. 22, 2005) by the same inventors, and claims priority therefrom. This divisional application is being filed in response to a restriction requirement in that prior application and contains re-written and/or additional claims to the restricted subject matter.

BACKGROUND OF THE INVENTION

The present invention relates to the field of finishing of documents and other printed or sheet materials. More particularly, the present invention relates to an improved and more efficient device and method for creating multiple punch holes during the finishing process of paper sheets and other materials. A highlight of the present invention is the ability to select between at least two configurations of punch holes automatically, without manual adjustment, and "on-the-fly" without interruption of the sheet or paper flow.

A common finishing process for documents and other printed matter is the punching of holes to allow sheets to be bound in a standard ring binder. Such binders are inherently flexible since they allow rearrangement of the order of sheets and allow insertions and deletions at will. Probably most students in the western world are familiar with the multi-ring school binder for homework, assignment papers, teacher handouts, etc. Multi-ring binders are also standard in many reference anthologies for the flexibility described above. As an example, volumes published by publisher Commerce Clearing House relating to various legal subjects such as tax, labor law, etc are found in virtually all legal libraries within the United States and are published in a standard 4-ring binder arrangement.

Reams of paper can be purchased with holes pre-punched during the paper production process. Most paper and sheets to be printed, however, are purchased without the pre-punching of holes. Such unpunched sheets allow users the flexibility of deciding if holes are to be subsequently punched, and, if punched, which configurations to use. There are many standard and non-standard punch configurations currently in use. The 3-hole punch arrangement of 8.5×11 inch (B4) paper is a North American standard although, as discussed above, 4-hole punch arrangements are also standard for some purposes. In Europe, A4 paper is typically punched in a 4-punch arrangement. Of course, paper that differs in size from A4 or B4 typically require different arrangements and spacings of punches.

Currently, for production processes requiring punch holes in sheet materials, production choices are limited. As described above, paper can often be purchased with holes-pre-punched. Yet such purchase requires advance knowledge of requirements and increased inventory costs. Finishing equipment can also be purchased that is capable of making hole punches at document production rates. Such punch hole finishing equipment has several limitations, however. First, hole punch apparatus in the prior art either requires a fixed arrangement of punches or requires that the production run be stopped in order to manually change the punch arrangement. Such work stoppage Is non-economic when the finishing processes are arranged in-line with expensive production equipment such as large lithographic presses or high speed reprographic systems such as modern electrophotographic production printers. A second limitation to current hole punch apparatus is that in order to provide for multiple hole punch arrangements without stopping the work flow, multiple punch stations must be inserted in the work flow line. Such multiple punch stations require additional capital investments and, more importantly, take valuable space.

It would be advantageous to have an apparatus that takes little or no space in an in-line finishing process that enables at least two and possibly more punch hole arrangements. With such a small footprint device, such flexible punch apparatus could be contained within the typical cabinets of high speed production electrophotographic printers and high speed finishing equipment in-line from high-speed lithographic and other presses. With such a device, a document production or other production line that typically uses two or three different punch arrangements can build the flexible punch of the present invention into standard production equipment and can avoid either the expense of duplicate equipment or the inventory cost and management problems resulting from acquiring pre-punched sheet materials. With the small foot-print size of the present invention, additional finishing capability can be built into printers and similar equipment without requiring production stoppage in order to change the punch arrangement.

SUMMARY OF THE INVENTION

One embodiment of the present invention is a process for making a perforation in a sheet moving in a sheet path, comprising: (a) selecting a first punch on a rotatable punch member for perforating the sheet wherein said rotatable member comprises a second punch positioned at an angle relative to the first punch such that when either first or second punches intersect the sheet path, the other punch is rotated to a position that does not intersect the sheet path; (b) determining the time at which a selected location on a sheet to be perforated will arrive at a location that intersects the selected punch; (c) activating a mechanism that drives the rotatable member the selected punch intersects the sheet path when the sheet location to be punched arrives at the point of intersection between the sheet path and the punch; and (d) controlling the deceleration of the rotatable member such that the non-selected punch intersects the sheet path in a space between pitches.

Another embodiment of the present invention is a marking system having a hole punch for perforating sheets moving in a sheet path having spaces between pitches, comprising: (a) a member rotatable in the direction of the sheet path; (b) a first punch attached to the rotatable member and positioned to intersect the sheet path when rotated to a position orthogonal to the sheet path; c) a second punch attached to the rotatable member, said second punch positioned to intersect the sheet path when rotated to a position orthogonal to the sheet path and positioned at an angle relative to the first punch such that when either the first or second punch intersect the sheet path, the other punch is rotated to a position that does not intersect the sheet path; (d) a drive mechanism for powering rotation of the rotating member; and (e) a controller, cooperating with the drive mechanism, for controlling the rotation of the rotatable member such that when one punch is selected for intersection with a sheet in the sheet path, rotation is timed such that the other punch intersects the sheet path in a space between pitches.

DETAILED DESCRIPTION OF THE DRAWINGS

While the present invention will hereinafter be described in connection with several embodiments and methods of use, it will be understood that this is not intended to limit the invention to these embodiments and methods of use. On the contrary, the following description is intended to cover all alternatives, modifications and equivalents, as may be included within the spirit and scope of the invention as defined by the appended claims.

Since one embodiment of the present invention is inclusion of an apparatus of the present invention in an electrophotographic printer, a description of the overall printing process with such a printer is now described. Inasmuch as the art of electrophotographic printing is well known, the various processing stations employed in the FIG. 5 printing machine will be shown hereinafter schematically and their operation described briefly with reference thereto.

Figure 5:
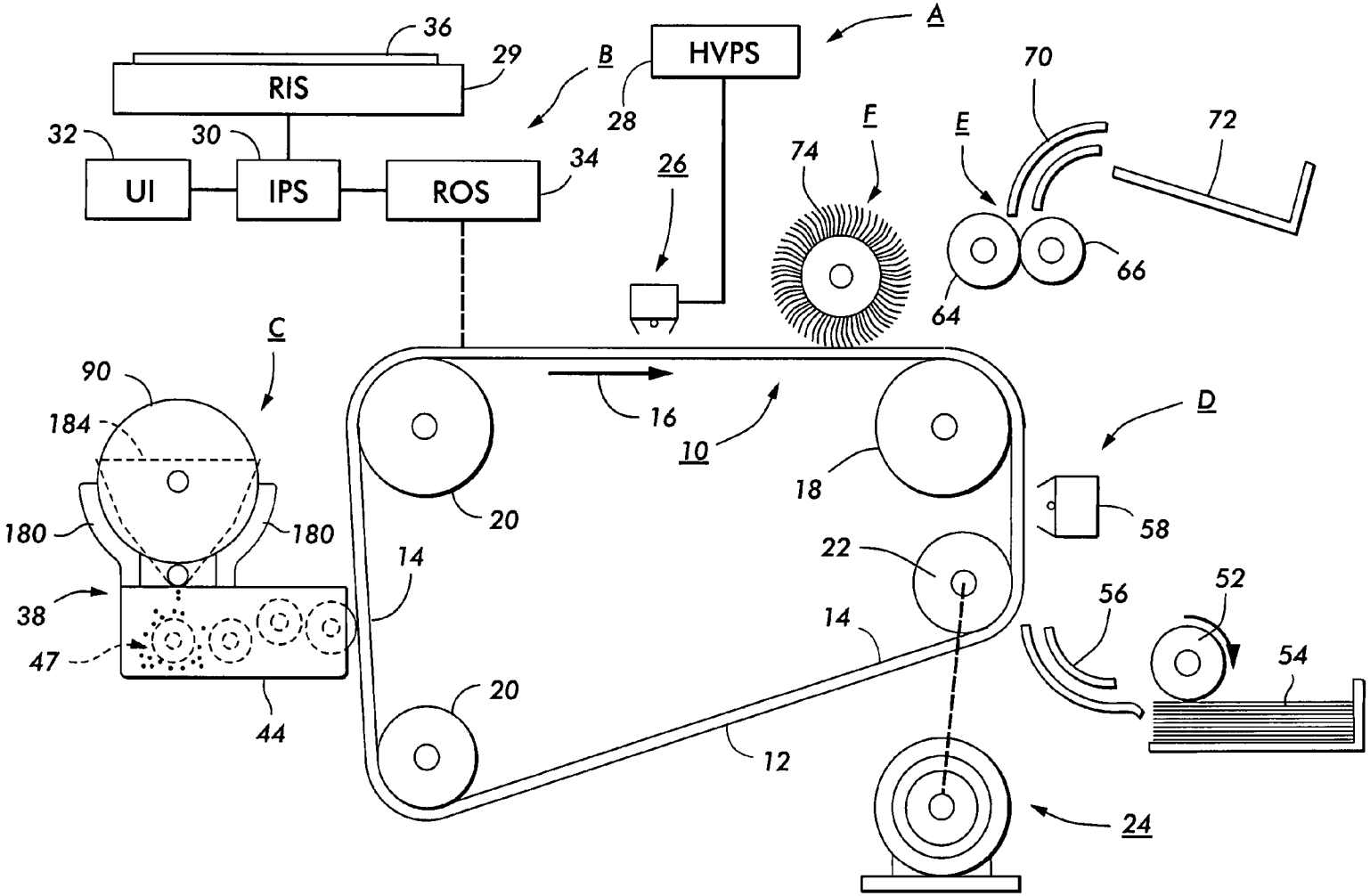
FIG. 5 is an elevated schematic view of an exemplary electrophotographic print system comprising the present invention.

Referring initially to FIG. 5, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy, which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics, which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 5. At development station C, a development system 38, develops the latent image recorded on the photoconductive surface. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 5, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the perforating apparatus of the present invention therein. A thought the perforating apparatus of the present invention may be installed in several places along the sheet path, it most commonly would be installed after Fusing station E and before output tray 72.

Figure 1:
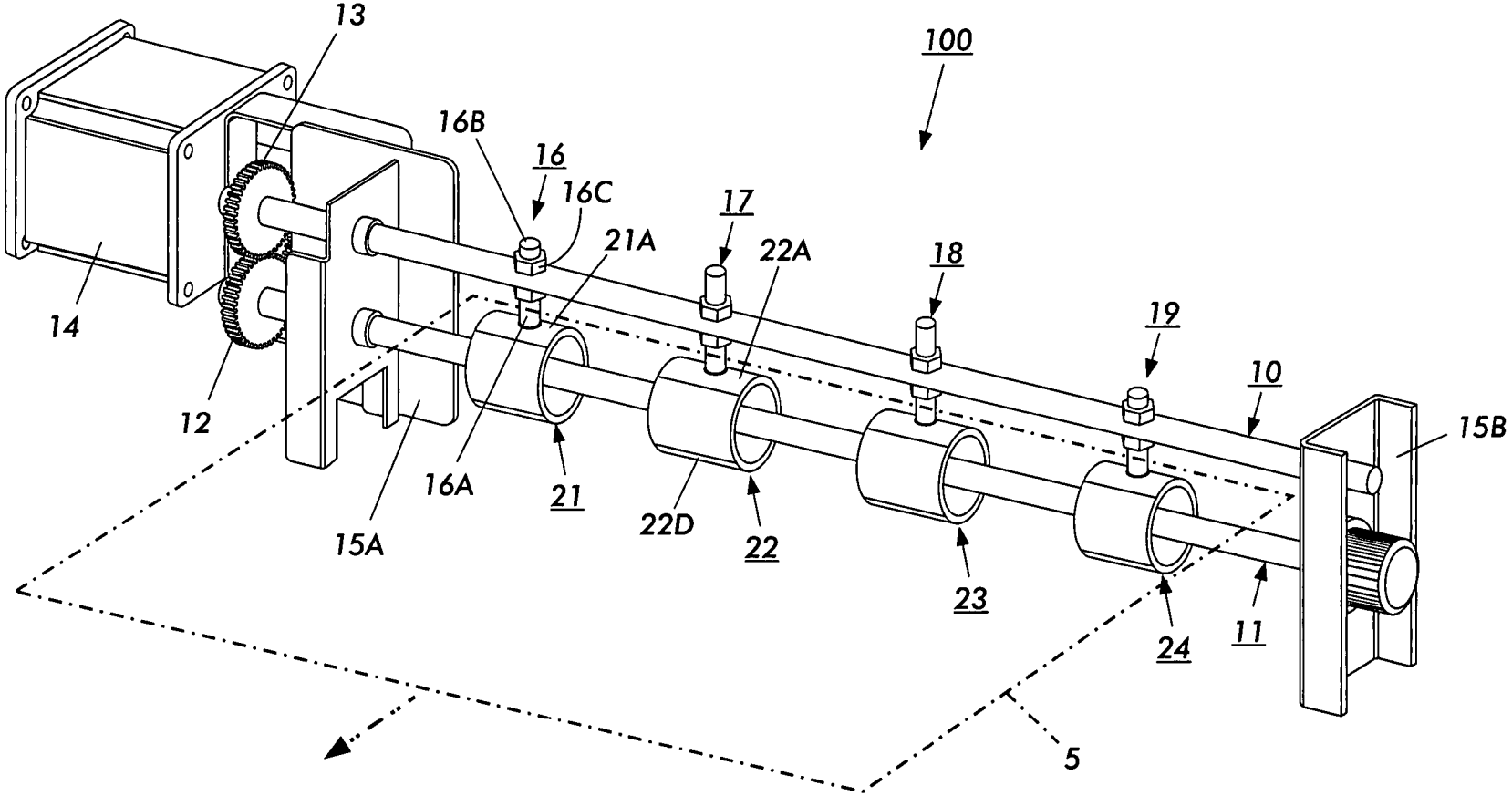
FIG. 1 is an elevated perspective view of the punch apparatus of the present invention showing a sheet being punched and one embodiment of the angular relationship between punches.

Turning now to FIG. 1, a perspective elevated view of the basic apparatus 100 of the present invention is shown. As shown, one embodiment of the present invention is built around two similarly sized mandrels, 10 and 11. Matching sun gears 12 and 13 mate such that rotation of one mandrel is synchronous with rotation of the other. Drive motor 14 drives rotation of either mandrel 10 or mandrel 11, and sun gears 12 and 13 cooperate impart the synchronous rotational motion to the other mandrel. Fixtures 15A and 15B maintain the relative positions of mandrels 10 and 11 in a substantially parallel manner.

In the embodiment shown, mandrel 10 further comprises 4 punch locations 16–19 while mandrel 11 further comprises 4 punch die locations 21–24 situated such that synchronous rotation of mandrels 11 and 12 results in mating of each punch on mandrel 10 with a punch die on mandrel 11. In FIG. 1, each punch is mated and seated firmly into its punch die counterpart. Sheet 5 is the work piece shown in FIG. 1 by the dotted lines. As shown, leading edge of sheet has passed over punch dies 21–24 such that punches 16–19 have perforated sheet 5 and made 4 holes.

The characteristics of punches 16–19 and punch dies 21–24 in the embodiment shown in FIG. 1 will now be discussed. As shown, punch 16 is mounted through a bore in mandrel 10 such that on one side of mandrel 10, punch 16 protrudes in the direction of punch die 21. The cutting edge 16A of punch 16 can assume any shape seemed applicable for the work pieces of the job. A typical hole punch comprises a concave punch face rimmed with a circular sharp cutting edge. Similarly, punch die recess 21A preferably conforms tightly to the size of mating punch 16A and comprises a depression with sharp edges. Hardened steel is a typical punch and die material.

Returning again to the embodiment shown in FIG. 1, punch 16 is mounted on a threaded bolt 16B that fits snugly through the bore in mandrel 10. Such threaded bolt 16B terminates on the opposite side of mandrel 10 with enough threads to be tightly secured by a threaded nut 16C. The length of punch 16A is determined by the size of sun gears 12 and 13 and the diameter of mandrel 10. Since both mandrel 10 and sun gear 13 are co-axial, the general length of punch 16A is typically slightly longer than the effective radius of sun gear 13. The extra length allows punch member 16A to cut through work piece 5 and to mate into the recess of punch die 21. Similarly, punch die 21 is a cylindrical member with a diameter determined in reference to sun gear 12. The diameter is slightly larger than the effective diameter of sun gear 12. Recess 21A is recessed into the body of punch die 21 such that it can completely receive the extra length of punch 16A. The net effect is that punch member 16A mates with punch die recess 21A tightly, and, when a sheet lies between, a hole is punched into the sheet.

Returning again to the embodiment shown in FIG. 1, punch 16 is mounted on a threaded bolt 16B that fits snugly through the bore in mandrel 10. Such threaded bolt 16B terminates on the opposite side of mandrel 10 with enough threads to be tightly secured by a threaded nut 16C. The length of punch 16A is determined by the size of sun gears 12 and 13 and the diameter of mandrel 10. Since both mandrel 10 and sun gear 13 are co-axial, the general length of punch 16A is typically slightly longer than the effective radius of sun gear 13. The extra length allows punch member 16A to cut through work piece 5 and to mate into the recess of punch die 21. Similarly, punch die 21 is a cylindrical member with a diameter determined in reference to sun gear 12. The diameter is slightly larger than the effective diameter of sun gear 12. Recess 21A is recessed into the body of punch die 21 such that it can completely receive the extra length of punch 16A. The net effect is that punch member 16A mates with punch die recess 21A tightly, and, when a sheet lies between, a hole is punched into the sheet.

In contrast to the punch side of punch member 16, bolt 16B and nut 16C extend outward from the center axis of mandrel 10 a distance that is less than the effective radius of sun gear 13. The purpose of this shortened length on the non-punch side of punch member 16 will be explained below in relation to the interaction of apparatus 100 of the present invention and sheet 5.

Each of punch arrangements 16–19 and mating punch dies 21–24 can be configured exactly as described above in relation to punch member 16. However, as shown in FIG. 1, it is also possible for different punch members to be configured differently. Specifically, in the embodiment shown, punch member 17 shows punches 17A and 17D on opposite sides of mandrel 10. Punch 17D in effect replaces the nut of punch member 16. Punch 17D in this embodiment is threadedly mounted to an internal bolt 17B (not shown), such that both punches 17A and 17D extend outwardly from mandrel 10 approximately an equal distance and 180 degrees apart. With this configuration, punch die member 22 has a recess 22D that is also situated 180 degrees apart from punch die recess 22A. The effect is that each time a punch rotates into position to impact work piece 5, a mating punch die has rotated into position to receive the punch.

The ability to vary either side of punch members 16–19 leads to some key advantages of the present invention. If both sides are configured identically, then total productivity of apparatus 100 can be increased since each rotation results in two punches. The key advantage, however, is the ability to configure one side of mandrel 10 differently from the opposite side. When combined with proper interactions with the work pieces and sequence timers to be explained below, such different configurations allows apparatus 100 to be preset for at least two separate punch configurations. By varying the timing as discussed below, apparatus 100 can switch automatically between such preset punch configurations without the need to stop the work flow. Such switches can even occur inline between sheets without missing a pitch. In the example shown in FIG. 1, apparatus 100 is preset to handle either 4-hole configurations or 2-hole configurations or both simultaneously.

It should be understood that the present invention can embody even greater flexibility than shown in the embodiment of FIG. 1. In other words, there can be any number of punch members and mating punch die members. There can be any number of bores to move the punches and dies into any number of standard configurations. Also, any number of mechanisms to locate punches and dies along mandrels 10 and 11 can increase flexibility. For instance, punches and dies can be slidably mounted mandrels 10 and 11 such that the position becomes independent of present bore holes. There can also simultaneously be preset locations and infinitely adjustable locations on the same mandrels. For instance, there may be both slidable location apparatus and bore holes. In yet another embodiment of the present invention, sun gears 12 and 13 may comprise gears of different sizes but having gear ratios that bear a uniform relationship to each other, i.e., sun gear 13 could be replaced by multiple gears having a gear ratio twice that of sun gear 12. The result would be that mandrel 10 moves twice as fast as mandrel 11. As long as the punches uniformly align with receiving punch dies, any such configuration is operable. Moreover, by increasing the size of mandrel 10, any number of punches in any configuration can be mounted. For instance, instead of punches located 180 degrees apart around the circumference of mandrel 10, three sets of punches could be spaced 120 degrees apart. As explained below, with a large enough mandrel 10, no interference with the work pieces will occur.

Figure 2:
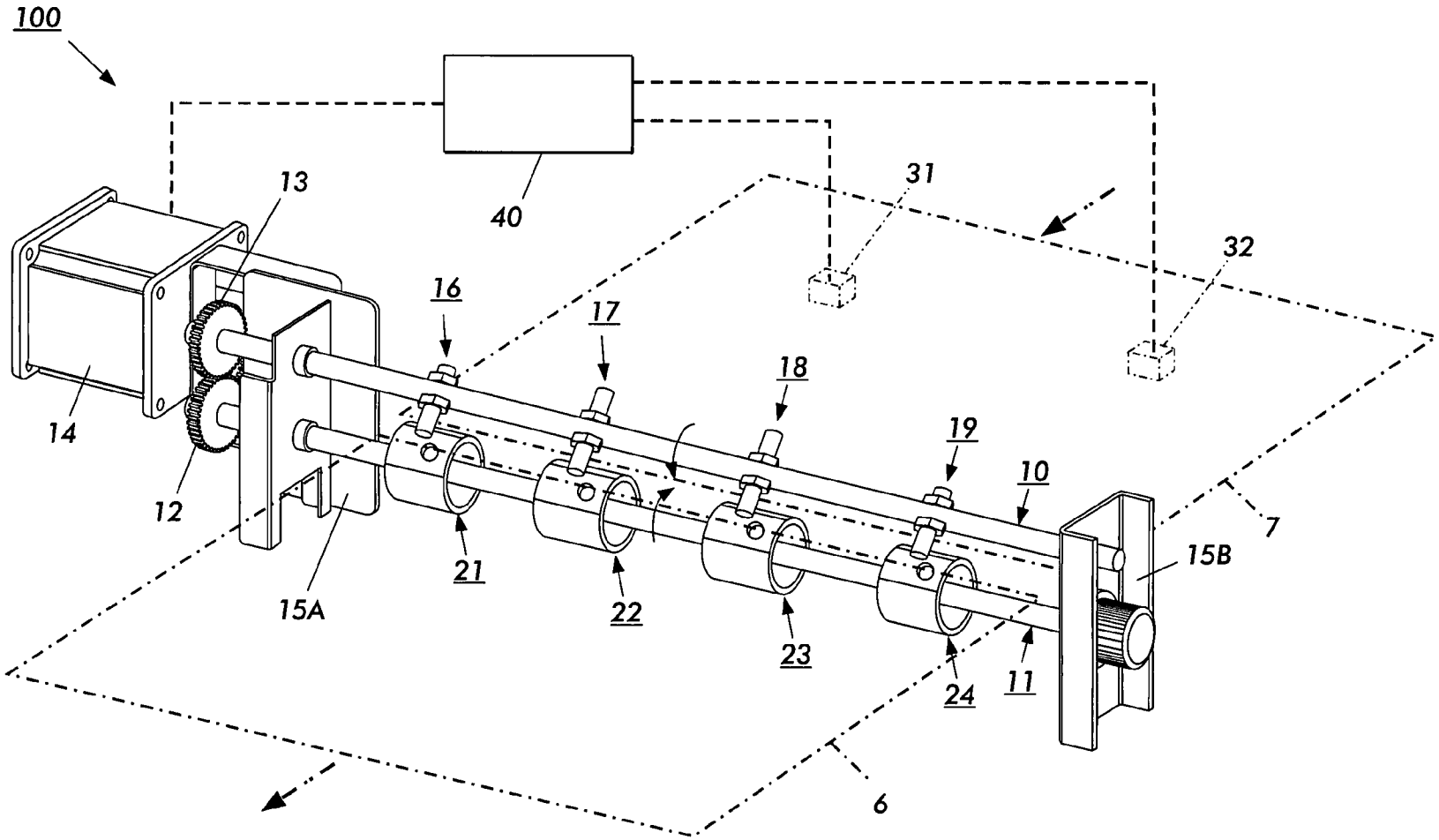
FIG. 2 is an elevated perspective view of the punch apparatus of the present invention showing a sheet passing the apparatus without being punched.

The interaction between punches 16–19, punch dies 21–24, and work pieces will now be explained. Turning now to FIG. 2, an elevated perspective view shows an unpunched sheet 6 approaching apparatus 100 of the present invention.

Figure 3:
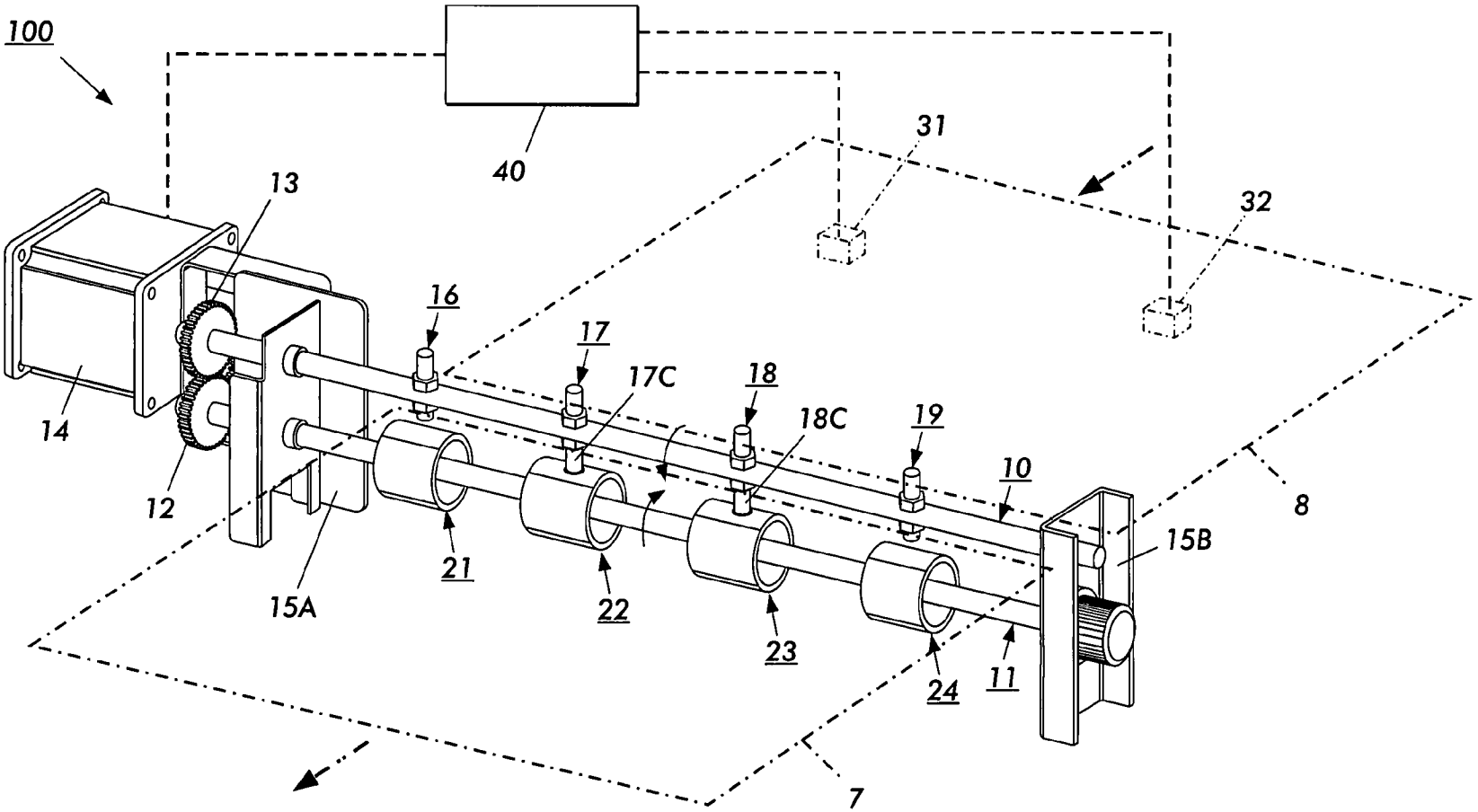
FIG. 3 is an elevated perspective view of the punch apparatus of the present invention showing another sheet passing the apparatus being punched.

As shown, apparatus 100 and its mandrels and punches are arranged laterally across the path of sheet 5. In FIG. 2, none of the punch stations 16–19 have elements in the path of sheet 6 since mandrel 10 has been rotated to a degree sufficient to raise all punch elements above the path of sheet 6. Mandrel 10 itself is not in contact with mandrel 11 or any portion of the path of sheet 5. Mandrel 11 is located such that the highest points of punch dies 21–24 are either below the path of sheet 6 or essentially tangent to the path. If no holes are desired in sheet 6, then apparatus 100 may remain the position shown in FIG. 2 or in any other configuration in which neither the punches or the punch dies obstruct the paper path. When holes are desired, however, motor 14 is activated by controller 40 in a timed sequence described below. Motor 14 accelerates mandrels 10 and 11 from still or essentially still up to a speed such that the tips of the punches to be engaged and of the punch dies are moving at a lateral speed in the direction of the path of sheet 6 approximately equal to the speed of sheet 6 itself. Turning now to FIG. 3, punches 17C and 18C have engaged sheet 7 by rotating approximately 300 degrees from the position shown in FIG. 2. By the time punches 17C and 18C engage sheet 7 and cooperate to punch a hole in such sheet, the portion of each punch and of each punch die that engages sheet 6 has been accelerated to match the speed by which sheet 2 is moving past apparatus 100. Without such matching speed, there is a risk that punches 17C and 18C may tear sheet 5 as it passes or at least perforate the sheet in an irregular manner.

Figure 4:
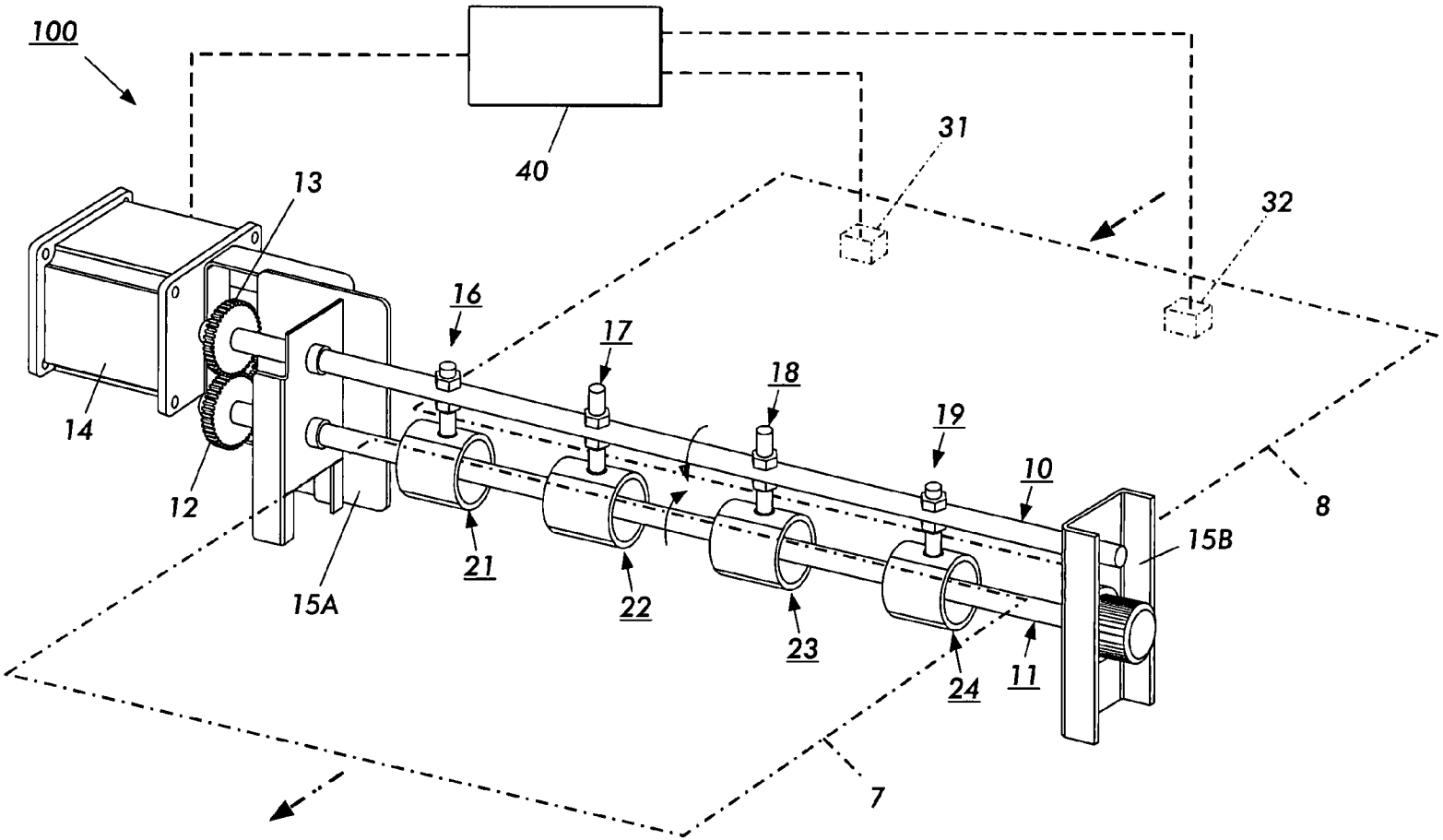
FIG. 4 is an elevated perspective view of the punch apparatus of the present invention showing the non-selected punch intersecting the sheet path in a space between pitches.

Turning to FIG. 4, the punches and punch dies have returned to the same orientation as shown in FIG. 1. The differences between FIG. 1 and FIG. 4 are several: First, sheet 7 in FIG. 3 has received 2 punch holes rather than 4. These holes were received as shown in FIG. 3. Secondly, punched sheet 7 has now advanced away from apparatus 100 further down its path. Thirdly, mandrel 11 has rotated 180 degrees from its orientation in FIG. 3 to return to the orientation of FIG. 1 but, unlike FIG. 1, punches 16A–19A contact punch dies 21A–24A between sheets, or pitches, in the paper path. In other words, rotation of mandrel 10 has been timed to place the 2-hole punch configuration onto sheet 6 at the appropriate location near the trailing edge of sheet 6. Mandrel 10 continues its rotation and is timed through controller 40 such that the 4-hole punch configuration is rendered non-operative since punches 16A–19A intersect their respective punch dies between pitches.

In the manner shown in the sequence of FIGS. 2–4, apparatus 100 can be configured simultaneously for a 2-hole and a 4-hole configuration yet only one or the other need be selected. The non-selected configuration is timed to intersect the sheet path between pitches while the selected configuration is timed to intersect the sheet path at the desired locations. To accomplish this result, an activation signal began a sequence that started motor 14, accelerated mandrels 10 and 11 such that the punches and punch dies intersect the sheet path at the correct time to make the selected punches and accelerated or decelerated the mandrels such that the non-selected punches and punch dies intersect the sheet path between pitches. After the non-selected punch and punch dies have intersected between pitches, then motor 14 generally continues rapid deceleration until an activation signal is received to for timing the intersection of the selected punches and punch dies on sheet 7, which is the trailing sheet. In such manner, the sequence can be continued indefinitely. As discussed, above, the sequence can also be alternated of changed on the fly such that the selected configuration becomes the non-selected configuration, etc. Unlike the prior art, all of this can be done without stopping the paper path or changing punch configurations.

One embodiment for sequencing the interaction between work pieces and the apparatus 100 of the present invention will now be explained. Returning to FIG. 2, trailing edge detectors 31 and 32 are shown underneath sheet 7. Such edge detectors are now highly accurate and conventional in the art. See, for instance, U.S. Pat. No. 6,266,512 B1, issued Jul. 24, 2001, by Dekoning, et al. As shown, sensors 31 and 32 may comprise LED on either top or bottom of the sheet path and light detectors on the opposite side of the sheet path. The result is that the light sensor receives no signal from its companion LED while the sheet obstructs the light path. As soon as the trailing edge has past, however, the light sensor receives the LED photons, and sends its signal to controller 40. Upon receipt of signals from detectors 31 and 32, controller 40 "knows" the location of the trailing edge of sheet 7. Other sensors and readings "know" the velocity of the sheet in its path. Such velocity can be sensed by a sequence of detectors such as 31 and 32 but arranged along the paper path rather than laterally across it. Such velocity may also be determined by the rate at which drive rolls are turning when in contact with the sheet. Determination of sheet velocity is also conventional and well known in the art of printing and finishing. The next item of data that must be fed into controller 40 is the location of the holes to be punched in relation to the trailing edge. These may be set as standards in a look-up table for particular size sheets or may be manually adjusted by human operators. All that remains for controller 40 is data concerning a fixed acceleration and deceleration rate of motor 14 or the ability to control such acceleration and deceleration. Once all of the above data are known, controller 40 can determine the timing and rate at which motor 14 should accelerate in order for the selected punches to intersect the sheet path at a particular distance from the trailing edge and for the non-selected punches to intersect the sheet path in the spaces between the pitches as shown in FIG. 4.

It should be understood that timing and sequencing of apparatus interacting within a sheet path of a printer, finisher, or similar apparatus is well known in the art and many variations are possible. One simple variation, for instance, is to detect the leading rather than the trailing edge. As discussed above, various mechanisms and methods are also available to sense sheet velocity and position. If desired, it is also conventional to detect sheet size in all dimensions. See, for example, U.S. Pat. No. 6,266,512, issued to DeKoning and the references therein. In review, the apparatus and method of the present invention includes a flexible sheet punch capable of being simultaneously configured for a plurality of punch configurations, thereby allowing operators to select and change between punch configurations without needing to stop or even slow a sheet production process. Because the apparatus of the present invention requires a small footprint, it may easily be added within small spaces available in printers, finishers, and similar apparatus. When compared to known sheet hole punch apparatus of the prior art, the present invention permits this small footprint and ability to select between multiple punch configurations leads to increased productivity and lower capital cost. It is, therefore, evident that there has been provided in accordance with the present invention a sheet hole punch apparatus and method that fully satisfies the aims and advantages set forth above. While the invention has been described in conjunction with several embodiments, it is evident that many alternatives, modifications, and variations will be apparent to those skilled in the art. Accordingly, it is intended to embrace all such alternatives, modifications, and variations as fall within the spirit and broad scope of the appended claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A process for making a perforation in sheets moving in a sheet path, comprising:

a. selecting a first or second punch on a rotatable punch member for perforating a sheet wherein said rotatable punch member comprises a second punch positioned at an angle relative to the first punch such that when said first punch intersects the sheet path the second punch is rotated to a position that does not intersect the sheet path;

b. determining the time at which a selected location on a sheet to be perforated will arrive in said sheet path at a location that intersects the selected punch;

c. operating a drive mechanism to continuously rotate the rotatable punch member during perforations of successive sheets so that a selected first or second punch intersects the sheet path when the sheet location to be punched arrives at the point of intersection between the sheet path and the selected punch; and d. controlling said operating of said drive mechanism of the rotatable member such that the non-selected punch intersects the sheet path in a space between pitches.

2. The perforation process of claim 1, wherein there is a different number of first punches than the number of second punches.

3. The perforation process of claim 1, wherein the first and second punches are oriented 180° from each other.

4. The perforation process of claim 1, wherein the rotatable punch member further comprises a third punch.

5. The perforation process of claim 1, wherein the sheet path has a width dimension and wherein the first and second punches are located at the same position along the width dimension.

6. The perforation process of claim 1, wherein the sheet path has a width dimension and wherein the first and second punches are located at different positions along the width dimension.

7. The perforation process of claim 1, wherein the speed of the drive mechanism is controllable.

8. The perforation process of claim 1, wherein the deceleration of the drive mechanism is controllable.

9. The perforation process of claim 1, wherein the drive mechanism is an electrical motor controlled by the controller.

10. The perforation process of claim 1, further comprising:

communicating data between sensors and a controller;

b. determining, with the controller, the location of a sheet in the sheet path; and c. using a controller algorithm, such data, and the location of a sheet to determine when to activate the drive mechanism.

11. The perforation process of claim 1, further comprising:

a. communicating data between sensors and a controller;

b. determining, with the controller, the location of a sheet in the sheet path; and c. using a controller algorithm, such data, and the location of a sheet to determine the acceleration of the drive mechanism in order to place the selected punch in the correct location.

12. The perforation process of claim 1, further comprising:

a. communicating data between sensors and a controller;

b. determining, with the controller, the location of a sheet in the sheet path; and c. using a controller algorithm, such data, and the location of a sheet to determine the deceleration of the drive mechanism in order to place the non-selected punch in a space between pitches.

13. The perforation process of claim 1, further comprising:

a. detecting, with a sensor proximate to the sheet path, a trailing edge of a sheet; and b. conveying such detection data to the controller.

14. The perforation process of claim 1, further comprising calculating, with a calculator receiving data from sensors, the velocity of a sheet in the sheet path.

15. The perforation process of claim 1, wherein the first punch comprises a plurality of punches.

16. The perforation process of claim 15, wherein the second punch comprises a plurality of punches.

17. The perforation process of claim 1, wherein leading and trailing edges comprise sheet path edges and wherein the perforation process further comprises using a sensor proximate to the sheet path for detecting a sheet path edge in the sheet path.

18. The perforation process of claim 17, wherein the controlling step uses signals from the sheet path detector in an algorithm to control the drive mechanism.

19. The perforation process of claim 1, wherein the sheet path has a width dimension and wherein a position of the first punch along the width dimension is variable.

20. The perforation process of claim 19, wherein the position of the first punch along the width dimension is continuously variable across at least a segment of the width.

21. The perforation process of claim 19, wherein the position of the first punch is variable among a plurality of fixedly located positions.

22. The perforation process of claim 1, further comprising receiving each punch with a punch die located on a rotatable punch die member while the punch intersects the sheet path.

23. The perforation process of claim 22, wherein the rotatable punch die member comprises at least two punch dies.

24. The perforation process of claim 22, further comprising connecting the rotatable punch member and the rotatable punch die member with a mechanism such that the punch and the punch die rotate at essentially the same speed.

* * * * *